US005492575A

United States Patent [19]

Teraoka et al.

[11] Patent Number: 5,492,575

[45] Date of Patent: Feb. 20, 1996

[54] PROCESS FOR PRODUCING THIN STRIP OF CR-STAINLESS STEEL HAVING HIGH TOUGHNESS

[75] Inventors: Shinichi Teraoka; Takehisa Mizunuma, both of Hikari; Takanori Nakazawa; Yuichi Satoh, both of Futtsu, all of Japan

[73] Assignee: Nippon Steel Corporation, Tokyo, Japan

[21] Appl. No.: 307,617

[22] PCT Filed: Jan. 27, 1994

[86] PCT No.: PCT/JP94/00112

§ 371 Date: Sep. 14, 1994

§ 102(e) Date: Sep. 14, 1994

[87] PCT Pub. No.: WO94/17215

PCT Pub. Date: Aug. 4, 1994

[30] Foreign Application Priority Data

Jan. 28, 1993 [JP] Japan ..... 5-012690

[51] Int. Cl.[6] ..... C21D 8/02

[52] U.S. Cl. ..... 148/542; 148/602; 148/609

[58] Field of Search ..... 148/542, 602, 148/609, 661

[56] References Cited

FOREIGN PATENT DOCUMENTS 2166233 6/1990 Japan ..... 148/542

2232317 9/1990 Japan ..... 148/542

*Primary Examiner*—Deborah Yee

*Attorney, Agent, or Firm*—Kenyon & Kenyon

[57] ABSTRACT

To produce a thin strip having a high cast strip toughness from a thin cast strip of a Cr-stainless steel containing Nb, Ti, and Al in an amount of 0.05% or more, a process includes the steps of: casting a thin cast strip of a Cr-stainless steel having a thickness of 10 mm or less, the steel containing 13–25 wt % of Cr, 0.05–1 wt % of one or more of Nb, Ti, Al and V in terms of a total amount, 0.03 wt % or less of C, 0.03 wt % or less of N, and 0.3–3.0 wt % of Mo in accordance with need, and having a γp value of 0% or less; hot-rolling the thin cast strip in a temperature range of from 1150° to 950° C. at a reduction in thickness of 5 to 50% to form a thin strip; either slowly cooling the thin strip at a rate of 20° C./sec or less or holding the thin strip for 5 sec or more, in a temperature range of from 1150° to 950° C.; and then coiling the thin strip at a temperature lower than 700° C.

γp(%)=420C+470N+23Ni+9Cu+7Mn−11.5Cr−11.5Si− 12 Mo−23V−47Nb−49 Ti−52Al+189 (respective elements in wt %).

2 Claims, 3 Drawing Sheets

PROCESS FOR PRODUCING THIN STRIP OF CR-STAINLESS STEEL HAVING HIGH TOUGHNESS

FIELD OF THE INVENTION

In recent years, a technology of casting a thin cast strip having a strip thickness of 10 mm or less directly from a steel melt was developed and tested on an industrial scale. This new technology provides a process of producing a cold-rolled thin sheet product, in which a hot rolling step is either simplified or omitted, and thereby attracts considerable attention and is expected from the view point of saving energy and cost.

Processes of producing a thin sheet, including the above process, will hereinafter be referred to as "STC processes" (Strip Casting Process). In contrast, processes of producing a cold-rolled thin sheet product which includes the steps of continuous-casting a 100 mm or more thick steel slab, hot-rolling the slab to a several millimeters thick hot-rolled strip, and cold-rolling the hot-rolled strip, will be referred to as a conventional process.

The present invention relates to a process of producing a thin cast strip having a high toughness, particularly a thin cast strip of a Cr-stainless steel containing Nb, Ti, Al, etc., by an STC process.

BACKGROUND ART

Conventionally, Cr-stainless steels were produced by a conventional hot rolling-process which included casting a slab and hot-rolling the slab. This process had a problem that ridging (or roping) occurs in the cold-rolled thin sheet products due to a texture established during hot rolling. Then, trials were conducted in which the STC process was used to cast a thin cast strip for producing a thin sheet product in which no ridging occurs. For example, Japanese Unexamined Patent Publication (Kokai) No. 62-176649 disclosed "Process of Producing Ferritic Stainless Steel Thin Strip Having No Roping". This publication, however, did not describe the reduction in toughness which occurs in Cr-stainless steels having a single phase structure and containing Nb, Ti, Al, and V in an amount of from 0.05 to 1.0 wt % in total. Therefore, there remains a problem that a cast strip of a Cr-stainless steel containing Nb, Ti, Al and V in the above-recited total amount has too low a toughness to be cold-rolled in a subsequent step.

Japanese Unexamined Patent Publication (Kokai) No. 64-4458 entitled "Rapid-Cooled Strip of Ferritic Stainless Steel Having High Toughness" disclosed that a cast strip having a high toughness can be produced by controlling its columnar crystal content to 70% or more, but did not consider the technological significance of the relationship between the toughness of and the precipitates in the cast strips of Cr-stainless steels containing NB, Ti, Al, and V.

The present inventors have been developing a technology of producing Cr-stainless steel thin sheet by using an STC process. As a result, it became apparent that cast strips have a poor toughness which causes cracking to occur during cold rolling of SUS 430 or other steel systems in which a γ-phase is precipitated during cooling after solidification to room temperature and a martensite phase transformed from the γ-phase remains at room temperature.

To prevent the precipitation of γ-phase during cooling after solidification to room temperature, the present inventors produced a thin cast strip of a Cr-stainless steel with a controlled chemical composition having a γp value of 0% or less. The term γp is a parameter predicting the precipitate amount of γ-phase based on the chemical composition. However, even when a Cr-stainless steel has a γp of 0% or less, there remains a problem that a cast strip has a poor toughness and is broken during cold rolling when it contains one or more of Nb, Ti, Al and V in an amount of 0.05 wt % or more in total.

The present inventors made a study and found that thin cast strips of Cr-stainless steels containing such elements and exhibiting a poor toughness contain fine precipitates with a size of 0.1 μm or less. It is known that such fine precipitates harden the steel matrix and thus deteriorates the toughness.

A thin cast strip cast by an STC process contains fine precipitates of 0.1 μm or less, probably because its speed of cooling after solidification to room temperature is much higher than that of a slab cast by the conventional process, so that those precipitates, which precipitate and can grow to several μ m during cooling of a slab by the conventional process, do not actually have sufficient time to precipitate and grow but precipitate in a fine form instead in a thin cast strip cast by an STC process.

Thus, to improve the toughness of a thin cast strip of a Cr-stainless steel containing one or more of Nb, Ti, Al and V in an amount of 0.05 wt % or more in total, it is required that precipitates be grown to 0.1 μm or greater.

This problem occurrs in Cr-stainless steels containing Nb, Ti, Al and/or V in an amount of 0.05 wt % or more, irrespective of the structure of a cast strip such as the content of columnar crystals.

It also became apparent that the conventional hot-rolling process has no problem concerning the toughness of hot-rolled and annealed sheets of the subject steels of the present invention and that the problem is specific to STC processes.

DISCLOSURE OF THE INVENTION

The object of the present invention is to solve the above-discussed problem in STC processes.

To achieve the object according to the present invention, there is provided a process of producing a thin strip of a Cr-stainless steel having a high toughness, characterized by the steps of: casting a thin cast strip of a Cr-stainless steel having a thickness of 10 mm or less, the steel containing 13–25 wt % of Cr, 0.05–1 wt % of one or more of Nb, Ti, Al and V in terms of a total amount, 0.03 wt % or less of C, 0.03 wt % or less of N, and 0.3–3.0 wt % of Mo in accordance with need, and having a γp value of 0% or less, γp being defined as $\gamma p(\%) = 420C+470N+23Ni+9Cu+7Mn-11.5Cr-11.5Si-12\ Mo-23V-47Nb-49\ Ti-52Al+189$ (respective elements in wt %); hot-rolling the thin cast strip in a temperature range of from 1150° to 950° C. at a reduction in thickness of 5 to 50% to form a thin strip; either slowly cooling the thin strip at a speed of 20° C./sec or less or holding the thin strip for 5 sec or more, in a temperature range of from 1150° to 950° C., or passing the thin strip through a heat treatment furnace held at a temperature of from 1150° to 950° C. for 5 sec or more; and then coiling the thin strip at a temperature lower than 700° C.

According to the present invention, the chemical composition of steel is numerically limited as mentioned above for the following reasons.

Cr: 13–25 wt %

Cr effectively improves the corrosion resistance, the oxidation resistance at high temperatures, and other properties of a steel. To ensure these properties at least to an extent necessary in the Cr-stainless steels for usual applications, the Cr content must be 13 wt % or more. This content is also a minimum amount necessary to control the γp value to be 0% or less by adjusting the contents of other components. On the other hand, the Cr content must be 25 wt % or less because the toughness is significantly reduced when the Cr content is more than 25 wt %.

γp: 0% or less

γp is a parameter for calculating the amount of precipitated γ-phase based on the chemical composition. Any precipitated γ-phase is transformed to martensite phase during cooling to room temperature and the hard martensite phase significantly deteriorates the toughness. Therefore, to prevent γ-phase from being precipitated, γp is limited to 0% or less.

γp is defined by the formula: γp (%)=420C+470N+23Ni+9Cu+7Mn−11.5Cr−11.5Si−12 Mo−23V−47Nb−49 Ti−52Al+189 (respective elements in wt %).

One or more of Ti, Al, Nb, V: 0.05 to 1.0 wt % in total

Generally, Ti, Al, Nb, and V are occasionally added to a ferritic stainless steel in order to improve the corrosion resistance and the formability. These elements, however, are precipitated in the form of fine particles in thin cast strips solidified by rapid cooling and deteriorate the toughness of the cast strip. When contained in an amount of less than 0.05 wt %, these elements are harmless to the toughness, but when present in an amount of 0.05 wt % or more, fine particles of about 0.1 μm are precipitated and deteriorate the toughness. Thus, the present invention is directed to an improvement of the toughness of Cr-stainless steels containing one or more of Ti, Al, Nb, and V in an amount of 0.05 wt % in total as specified as a lower limit in the claims. The upper limit is specified as 1.0 wt %, because an amount greater than 1.0 wt % does not further improve the corrosion resistance and the formability under usual environmental conditions.

C, N: 0.030 wt % or less

Generally, C and N cause Cr to precipitate as a carbonitride on grain boundaries, and thereby, deteriorate the grain boundary corrosion resistance and the toughness. Therefore, the contents of these elements must be as small as possible and limited to 0.030 wt % or less.

Mo: 0.3 to 3.0 wt %

Similar to Cr, Mo effectively improves corrosion resistance. Thus, Mo is present together with Cr to improve the corrosion resistance in an amount of 0.3 wt % or more to ensure this effect but must not be more than 3% because greater amounts would induce the embrittlement due to the precipitation of sigma and chi phases.

The cast strips are hot-rolled and cooled under the conditions specified for the following reasons.

STC process uses rapid cooling of cast strips after casting and therefore there is only a little time for the precipitation and growth of the precipitated particles. Therefore, a heat treatment for the precipitation and growth is necessary. Because a thin cast strip has only a few precipitation sites, the heat treatment must be carried out at a high temperature for a long time to induce the precipitation and growth. To perform such a heat treatment on the cast strip immediately after casting, there is a problem that a long and large heat treatment line is necessary.

Thus, it is desired to provide a technology which enables the precipitation and growth to occur in a short time. Introduction of dislocations providing nuclei for precipitation effectively facilitates the precipitation. Namely, hot rolling in a precipitation temperature region effectively promotes precipitation. After the hot rolling to promote the precipitation, a slow cooling or an isothermal holding is performed to cause the precipitates to grow. These treatments ensure the precipitation and growth of the precipitates in a short time and render any precipitates in a cast strip harmless.

Cast strips are hot-rolled at a temperature of from 1150° to 950° C. and at a reduction in thickness of 5% or more, based on the following experimental results.

The present inventors carried out a laboratory experiment, in which a Fe-19 wt % Cr-0.60 wt % Nb-0.015 wt % C-0.015 wt % N steel was cast into 3 mm thick cast strips, which were then hot-rolled in a temperature range of from 1200° to 800° C. with a reduction in thickness of 3 to 50% to form thin strips. The hot-rolled thin strips were then passed through a heat treatment furnace held at 1100° C. for 10 sec, were secondarily cooled at 100° C./sec to 500° C., and were then coiled. The thin strips were subjected to a Charpy impact test at room temperature to estimate the toughness. The Charpy impact test was performed by using a specimen with the thickness of the thin strip.

The results are summarized in FIG. 1. The cast strips had a high toughness when hot-rolled at a reduction in thickness of 5% or more and at a temperature of from 950° to 1150° C. It is believed that carbonitrides were not rendered harmless because carbonitrides are not precipitated at temperatures above 1150° C. and because carbonitrides, even if precipitated, do not grow fast at temperatures below 950° C.

The hot rolling must be performed at a reduction in thickness of 50% or less, because higher reductions cause spill-like defects to occur.

The hot-rolled strip is either held for 5 sec or longer or slowly cooled at 20° C./sec or less, in a temperature range of from 1150° to 950° C. These conditions are determined by the following experiment.

The present inventors carried out an experiment, in which a Fe-19 wt % Cr-0.60 wt % Nb-0.015 wt % C-0.015 wt % N steel was cast into 3 mm thick cast strips, which were then hot-rolled at 1000° C. at a reduction in thickness of 10%. The hot-rolled strips were heat-treated under different conditions, secondarily cooled at 100° C./sec to 500° C., and coiled. The hot-rolled strips were subjected to a Charpy impact test at room temperature to estimate the toughness. The Charpy impact test was performed by using a specimen with the thickness of the thin strip.

The results are summarized in FIGS. 2 and 3. The hot-rolled strips had a high toughness when held for 5 sec or more or slowly cooled at 20° C./sec or less in a temperature region of from 1150° to 950° C. Poor toughness was obtained under other conditions, probably because carbonitrides did not grow sufficiently.

It is advantageous for process control that the heat treatment after hot rolling is effected by passing the hot-rolled strip through a heat treating furnace held at a temperature of from 1150° to 950° C. In this case, the hot-rolled strips also had a high toughness after being passed through the furnace for 5 sec or more in a temperature region of from 1150° to 950° C.

Stainless steels containing elements such as Ti and Nb, when held at 700° to 900° C. for a long period of time, have a poor toughness due to precipitation of very brittle intermetallic compounds (Laves phase). Thus, the strip must be coiled at a temperature of lower than 700° C.

This control of precipitates by hot rolling and heat treatment under the above-stated conditions was proved to be effective not only with Nb-containing steels but also with Ti- or Al-containing steels.

BEST MODE FOR CARRYING OUT THE INVENTION

EXAMPLE

Figure 1:
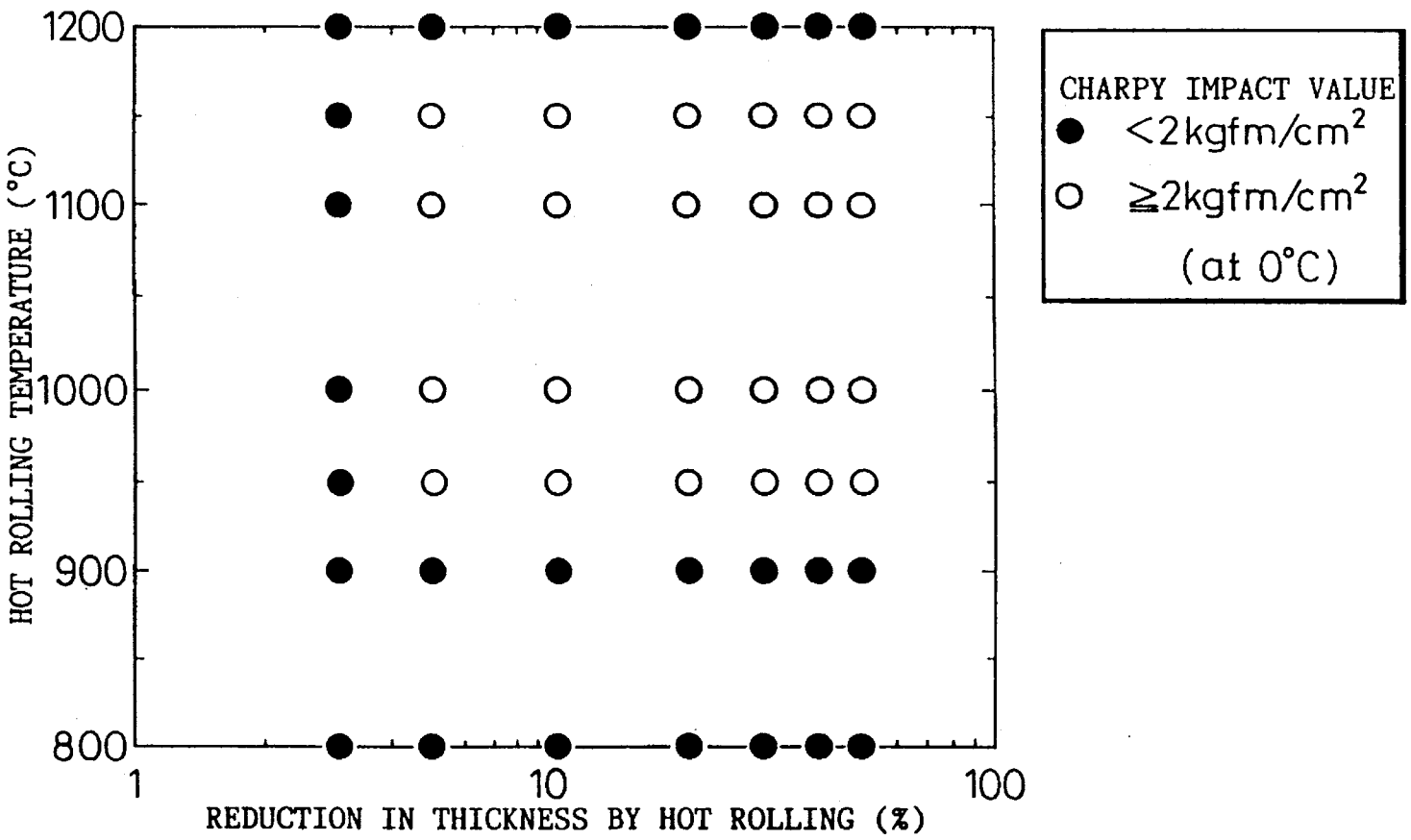
FIG. 1 is a graph showing the relationship between the hot rolling conditions of the cast strip and the cast strip toughness.
Figure 2:
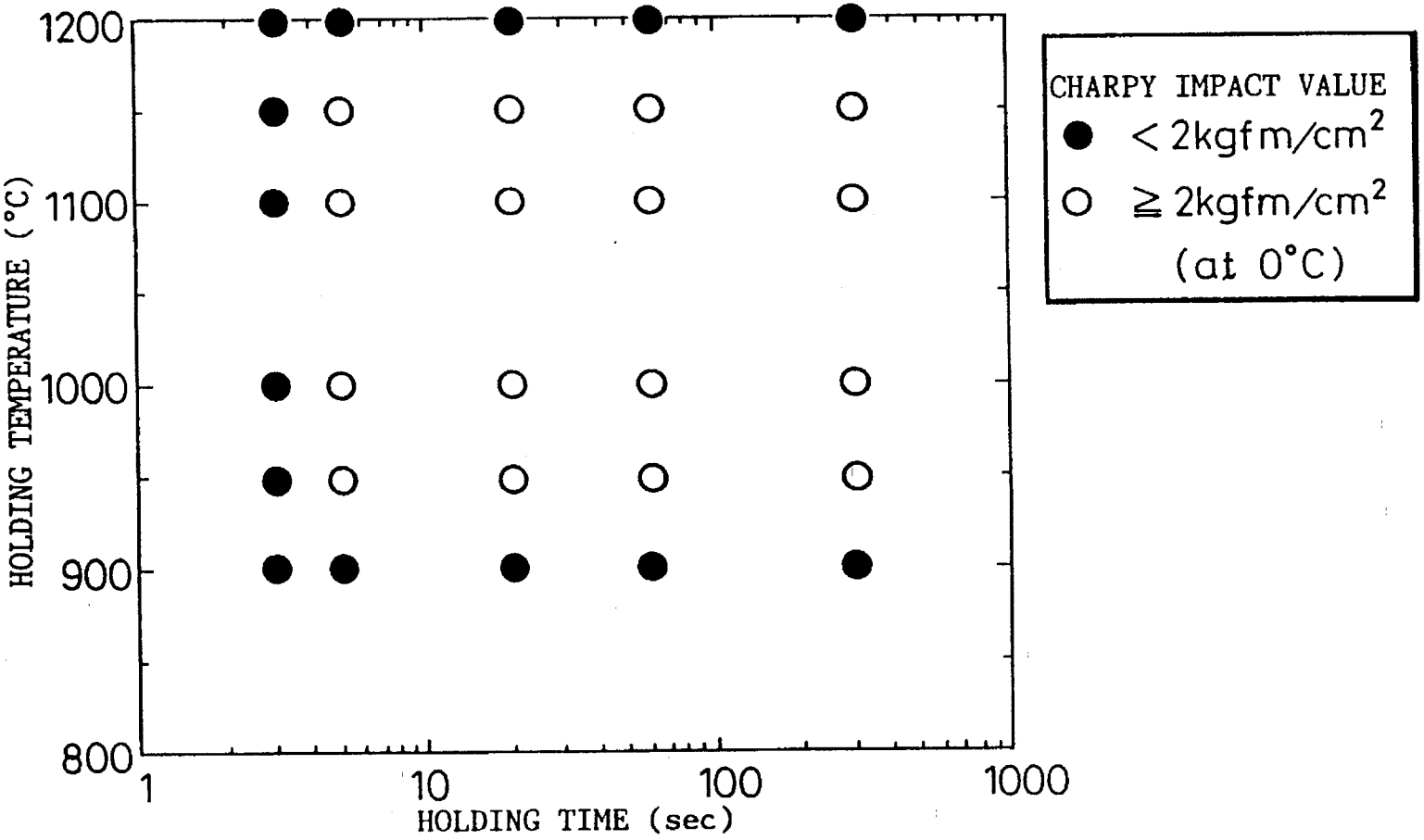
FIG. 2 is a graph showing the relationship between the heat treatment conditions after hot rolling and the cast strip toughness.
Figure 3:
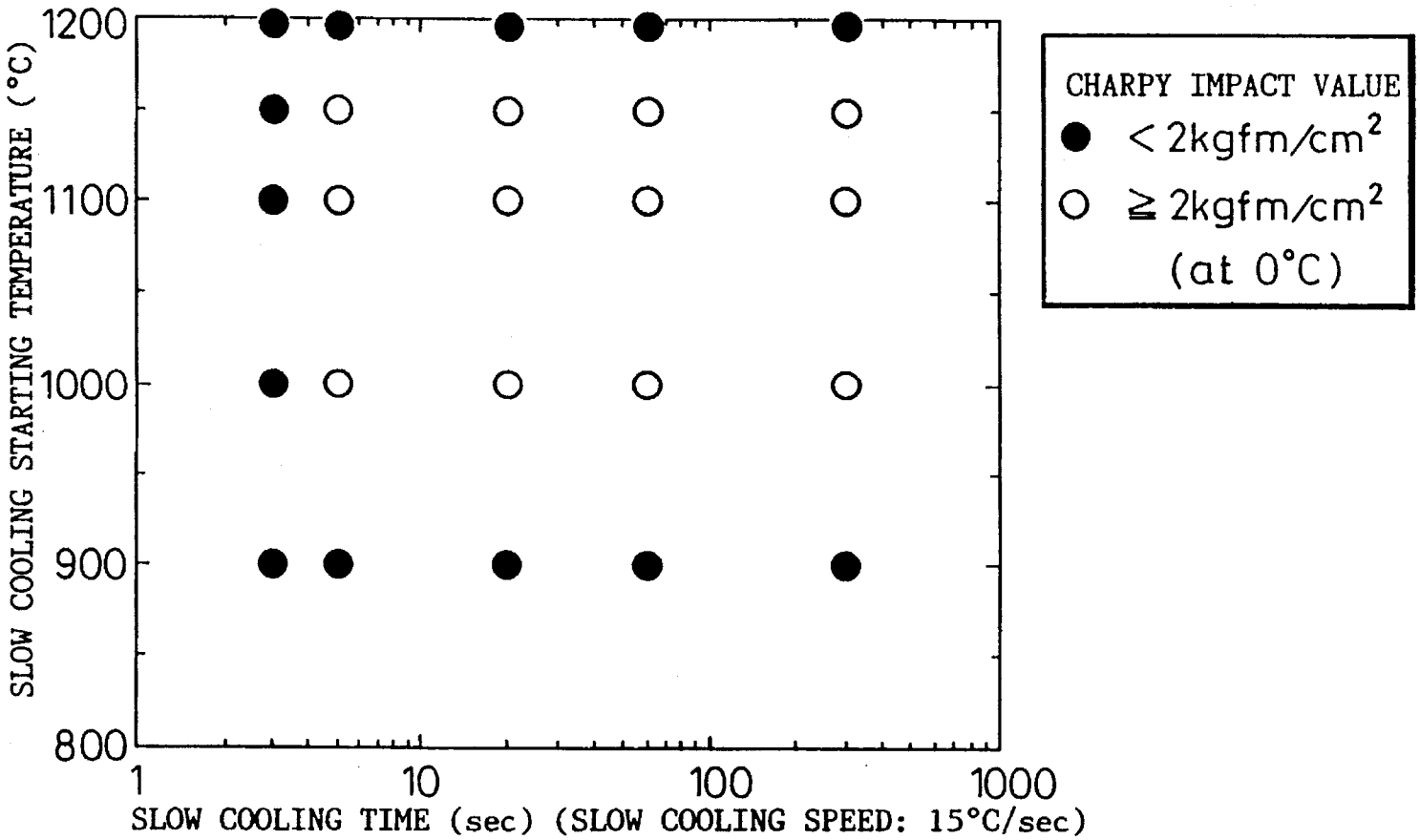
FIG. 3 is a graph showing the relationship between the heat treatment conditions after hot rolling and the cast strip toughness.

Various Cr-stainless steels having the chemical compositions shown in Table 1 within the claimed range of the present invention were melted to provide 10-ton melts, which were then cast to thin cast strips having a thickness of 3 mm in a water-cooled twin-drum caster. The cast strips were hot-rolled in the temperature range of from 1150° to 950° C. at different reductions in thickness of from 5 to 50%, were held, or slowly cooled, for 5 sec in the temperature range of from 1150° to 950° C., and were coiled in the form of a thin strip.

For comparison, Cr-stainless steels having the chemical compositions shown in Table 1 as comparative examples were also cast in a similar manner. The cast strips were hot-rolled, heat-treated after the hot rolling, and coiled under the respective conditions, at least one of which was outside the claimed range, to produce thin strips.

As can be seen from Table 2, the thin strips produced by the present inventive process had a high toughness of 2 kgf-m/cm$^2$ or greater at 0° C. whereas the thin strips produced by the comparative process had too low a toughness of less than 2 kgf-m/cm$^2$ to carry out the subsequent step of cold rolling.

TABLE 1

| No. | | C | Si | Mn | Ni | Cr | Mo | Cu | Nb | V | Ti | Al | O | N | γp | Nb + Ti + Al + V |
|---|---|---|---|---|---|---|---|---|---|---|---|---|---|---|---|---|
| Inven- | 1 | 0.010 | 0.5 | 0.2 | 0.1 | 13.2 | 2.0 | 0.1 | 0.650 | 0.005 | 0.050 | 0.003 | 0.0062 | 0.0080 | −1.8 | 0.708 |
| tion | 2 | 0.010 | 0.5 | 0.2 | 0.1 | 15.4 | 0.1 | 0.1 | 0.600 | 0.005 | 0.050 | 0.003 | 0.0047 | 0.0080 | −1.9 | 0.658 |
| | 3 | 0.010 | 0.5 | 0.2 | 0.1 | 17.8 | 0.0 | 0.1 | 0.600 | 0.005 | 0.050 | 0.003 | 0.0052 | 0.0080 | −28.4 | 0.658 |
| | 4 | 0.010 | 0.5 | 0.2 | 0.1 | 19.5 | 0.0 | 0.1 | 0.600 | 0.005 | 0.050 | 0.003 | 0.0064 | 0.0080 | −48.0 | 0.658 |
| | 5 | 0.010 | 0.5 | 0.2 | 0.1 | 21.1 | 0.0 | 0.1 | 0.600 | 0.005 | 0.050 | 0.003 | 0.0078 | 0.0080 | −66.4 | 0.658 |
| | 6 | 0.010 | 0.5 | 0.2 | 0.1 | 24.8 | 0.0 | 0.1 | 0.600 | 0.005 | 0.050 | 0.003 | 0.0050 | 0.0080 | −108.9 | 0.658 |
| | 7 | 0.030 | 0.5 | 0.0 | 0.1 | 19.1 | 0.1 | 0.2 | 0.050 | 0.000 | 0.000 | 0.003 | 0.0080 | 0.0210 | −3.3 | 0.053 |
| | 8 | 0.030 | 0.5 | 0.0 | 0.1 | 19.1 | 0.1 | 0.2 | 0.100 | 0.000 | 0.000 | 0.003 | 0.0089 | 0.0210 | −5.7 | 0.103 |
| | 9 | 0.030 | 0.5 | 0.0 | 0.1 | 19.1 | 0.1 | 0.2 | 0.200 | 0.000 | 0.000 | 0.003 | 0.0074 | 0.0210 | −10.4 | 0.203 |
| | 10 | 0.030 | 0.5 | 0.0 | 0.1 | 19.1 | 0.1 | 0.2 | 0.300 | 0.000 | 0.000 | 0.003 | 0.0080 | 0.0210 | −15.1 | 0.303 |
| | 11 | 0.030 | 0.5 | 0.0 | 0.1 | 19.1 | 0.1 | 0.2 | 0.400 | 0.000 | 0.000 | 0.003 | 0.0092 | 0.0210 | −19.8 | 0.403 |
| | 12 | 0.030 | 0.5 | 0.0 | 0.1 | 19.1 | 0.1 | 0.2 | 0.500 | 0.000 | 0.000 | 0.003 | 0.0073 | 0.0210 | −24.5 | 0.503 |
| | 13 | 0.030 | 0.5 | 0.0 | 0.1 | 19.1 | 0.1 | 0.2 | 0.000 | 0.030 | 0.000 | 0.030 | 0.0067 | 0.0210 | −3.1 | 0.060 |
| | 14 | 0.030 | 0.5 | 0.0 | 0.1 | 19.1 | 0.3 | 0.2 | 0.000 | 0.000 | 0.050 | 0.030 | 0.0069 | 0.0210 | −7.2 | 0.080 |
| | 15 | 0.030 | 0.5 | 0.0 | 0.1 | 19.1 | 0.1 | 0.2 | 0.000 | 0.000 | 0.000 | 0.050 | 0.0091 | 0.0210 | −3.4 | 0.050 |
| | 16 | 0.030 | 0.5 | 0.0 | 0.1 | 19.1 | 0.1 | 0.2 | 0.020 | 0.030 | 0.000 | 0.003 | 0.0141 | 0.0210 | −2.6 | 0.053 |
| | 17 | 0.030 | 0.5 | 0.0 | 0.1 | 19.1 | 0.3 | 0.2 | 0.020 | 0.000 | 0.030 | 0.005 | 0.0072 | 0.0210 | −5.9 | 0.055 |
| | 18 | 0.029 | 0.5 | 0.0 | 0.1 | 19.1 | 0.3 | 0.2 | 0.000 | 0.050 | 0.400 | 0.005 | 0.0078 | 0.0210 | −24.7 | 0.455 |
| | 19 | 0.030 | 0.5 | 0.0 | 0.1 | 19.1 | 0.3 | 0.2 | 0.000 | 0.000 | 0.030 | 0.030 | 0.0095 | 0.0210 | −6.3 | 0.060 |
| | 20 | 0.030 | 0.5 | 0.0 | 0.1 | 19.1 | 3.0 | 0.2 | 0.030 | 0.000 | 0.020 | 0.003 | 0.0087 | 0.0300 | −34.0 | 0.053 |
| Compa- | 21 | 0.010 | 0.5 | 0.2 | 0.1 | 12.0 | 2.0 | 0.1 | 0.650 | 0.005 | 0.030 | 0.003 | 0.0055 | 0.0080 | 13.0 | 0.688 |
| rison | 22 | 0.010 | 0.5 | 0.2 | 0.1 | 26.0 | 2.0 | 0.1 | 0.650 | 0.005 | 0.050 | 0.003 | 0.0054 | 0.0080 | −149.0 | 0.708 |
| | 23 | 0.032 | 0.5 | 0.0 | 0.1 | 19.1 | 0.1 | 0.2 | 0.100 | 0.000 | 0.005 | 0.003 | 0.0092 | 0.0210 | −5.1 | 0.108 |
| | 24 | 0.032 | 0.5 | 0.0 | 0.1 | 19.1 | 0.1 | 0.2 | 0.000 | 0.200 | 0.005 | 0.003 | 0.0074 | 0.0210 | −5.0 | 0.208 |
| | 25 | 0.032 | 0.5 | 0.0 | 0.1 | 19.1 | 0.1 | 0.2 | 0.000 | 0.000 | 0.200 | 0.003 | 0.0069 | 0.0210 | −10.0 | 0.203 |

TABLE 2

| Test No. | | Steel | Hot rolling Temp. (°C.) | Hot rolling Reduction (%) | Heat treatment after hot rolling Temp. (°C.) | Heat treatment after hot rolling Time (sec) | Heat treatment after hot rolling Cooling speed (°C./sec) | Coiling temp. (°C.) | Charpy impact value (0° C.) (kgf · m/cm²) |
|---|---|---|---|---|---|---|---|---|---|
| Invention | a | 1 | 1100 | 10 | 1000 | 10 | 0 | 500 | 12.9 |
| | b | 2 | 1100 | 10 | 1000 | 10 | 0 | 500 | 13.4 |
| | c | 3 | 1100 | 10 | 1000 | 10 | 0 | 500 | 12.4 |
| | d | 4 | 1100 | 10 | 1000 | 10 | 0 | 500 | 6.8 |
| | e | 5 | 1100 | 10 | 1000 | 10 | 0 | 500 | 5.4 |
| | f | 6 | 1100 | 10 | 1000 | 10 | 0 | 500 | 3.4 |
| | g | 7 | 1100 | 10 | 1000 | 10 | 0 | 500 | 12.4 |
| | h | 8 | 1100 | 10 | 1000 | 10 | 0 | 500 | 11.4 |
| | i | 9 | 1100 | 10 | 1000 | 10 | 0 | 500 | 13.5 |
| | j | 10 | 1100 | 10 | 1000 | 10 | 0 | 500 | 18.4 |
| | k | 11 | 1100 | 10 | 1000 | 10 | 0 | 500 | 12.4 |
| | l | 12 | 1100 | 10 | 1000 | 10 | 0 | 500 | 15.2 |
| | m | 13 | 1100 | 10 | 1000 | 10 | 0 | 500 | 15.4 |
| | n | 14 | 1100 | 10 | 1000 | 10 | 0 | 500 | 16.2 |
| | o | 15 | 1100 | 10 | 1000 | 10 | 0 | 500 | 14.8 |
| | p | 16 | 1100 | 10 | 1000 | 10 | 0 | 500 | 14.2 |
| | q | 17 | 1100 | 10 | 1000 | 10 | 0 | 500 | 14.3 |
| | r | 18 | 1100 | 10 | 1000 | 10 | 0 | 500 | 13.4 |
| | s | 19 | 1100 | 10 | 1000 | 10 | 0 | 500 | 15.2 |
| | t | 20 | 1100 | 10 | 1000 | 10 | 0 | 500 | 11 |
| | u | 10 | 1150 | 10 | 1000 | 10 | 0 | 500 | 14 |
| | v | 10 | 1050 | 10 | 1000 | 10 | 0 | 500 | 8.2 |
| | w | 10 | 1000 | 10 | 1000 | 10 | 0 | 500 | 7.8 |
| | x | 10 | 950 | 10 | 1000 | 10 | 0 | 500 | 11 |
| | y | 10 | 950 | 10 | 1000 | 10 | 0 | 500 | 8.9 |
| | z | 10 | 1100 | 40 | 1000 | 10 | 0 | 500 | 15.4 |
| | aa | 10 | 1100 | 5 | 1000 | 10 | 0 | 500 | 12.2 |
| | ab | 10 | 1150 | 10 | 1150 | 10 | 0 | 500 | 11.8 |
| | ac | 10 | 950 | 10 | 950 | 60 | 0 | 500 | 10.9 |
| | ad | 10 | 1100 | 20 | 1000 | 20 | 10 | 500 | 11.4 |
| | ae | 10 | 1100 | 20 | 1000 | 5 | 5 | 500 | 12 |
| | af | 10 | 1150 | 20 | 1100 | 5 | 20 | 500 | 10.9 |
| | ah | 10 | 1150 | 20 | 1100 | 10 | 1 | 680 | 8.5 |
| Comparison | ai | 21 | Not hot-rolled | | | Not heat-treated | | 500 | 0.3 |
| | aj | 22 | Not hot-rolled | | | Not heat-treated | | 500 | 0.3 |
| | ak | 23 | Not hot-rolled | | | Not heat-treated | | 500 | 0.3 |
| | al | 24 | Not hot-rolled | | | Not heat-treated | | 500 | 0.3 |
| | am | 25 | Not hot-rolled | | | Not heat-treated | | 500 | 0.2 |
| | an | 23 | Not hot-rolled | | | Not heat-treated | | 800 | 0.3 |
| | ao | 23 | 1100 | 3 | 1000 | 10 | 10 | 500 | 0.3 |
| | ap | 23 | 800 | 20 | 1000 | 10 | 0 | 400 | 0.3 |
| | aq | 23 | Not hot-rolled | | 1100 | 20 | 0 | 500 | 1.2 |
| | ar | 23 | 1100 | 10 | | Not heat-treated | | 600 | 0.8 |

INDUSTRIAL APPLICABILITY

As hereinbefore-described, the present invention provides a process of producing, by an STC process, a thin cast strip of a Cr-stainless steel having a high toughness, thereby providing an extremely great technological and economical advantage.

We claim:

1. A process of producing a thin strip of a Cr-stainless steel having a high toughness, characterized by the steps of: casting a thin cast strip of a Cr-stainless steel having a thickness of 10 mm or less, said steel containing 13–25 wt % of Cr, 0.05–1 wt % of one or more of Nb, Ti, Al and V in terms of a total amount, 0.03 wt % or less of C, 0.03 wt % or less of N, and 0.3–3.0 wt % of Mo in accordance with need, and having a γP value of 0% or less, said γp being defined as γp(%)=420C+470N+23Ni+9Cu+7Mn−11.5Cr−11.5Si−12 Mo−23V−47Nb−49 Ti−52Al+189 (respective elements in wt %); hot-rolling said thin cast strip in a temperature range of from 1150° to 950° C. at a reduction in thickness of 5 to 50% to form a thin strip; either slowly cooling said thin strip at a rate of 20° C./sec or less or holding said thin strip for 5 sec or more, in a temperature range of from 1150° to 950° C.; and then coiling said thin strip at a temperature lower than 700° C.

2. A process of producing a thin strip of a Cr-stainless steel having a high toughness, characterized by the steps of: casting a thin cast strip of a Cr-stainless steel having a thickness of 10 mm or less, said steel containing 13–25 wt % of Cr, 0.05–1 wt % of one or more of Nb, Ti, Al and V in terms of a total amount, 0.03 wt % or less of C, 0.03 wt % or less of N, and 0.3–3.0 wt % of Mo in accordance with need, and having a γp value of 0% or less, said γp being defined as γp(%)=420C+470N+23Ni+9Cu+7Mn−11.5Cr−11.5Si−12 Mo−23V−47Nb−49 Ti−52Al+189 (respective elements in wt %); hot-rolling said thin cast strip in a temperature range of from 1150° to 950° C. at a reduction in thickness of 5 to 50% to form a thin strip; passing said thin strip through a heat treatment furnace held at a temperature of from 1150° to 950° C. for 5 sec or more; and then coiling said thin strip at a temperature lower than 700° C.

* * * * *

UNITED STATES PATENT AND TRADEMARK OFFICE

CERTIFICATE OF CORRECTION

PATENT NO. : 5,492,575
DATED : February 20, 1996
INVENTOR(S) : Shinichi TERAOKA, et al.

It is certified that error appears in the above-indentified patent and that said Letters Patent is hereby corrected as shown below:

Column 2, line 52, change "...-12 Mo-..." to --...-12Mo-...-- and change "...-49 Ti-..." to --...-49Ti-...--.

Column 3, line 18, change "...-12 Mo-..." to --...-12Mo-...-- and change "...-49 Ti-..." to --...-49Ti-...--.

Column 7, line 61, change "...-12 Mo-..." to --...-12Mo-...-- and change "...-49 Ti-..." to --...49Ti-...--.

Column 8, line 56, change "...-12 Mo-..." to --...-12Mo-...-- and change "...-49 Ti-..." to --...-49Ti-...--.

Signed and Sealed this
Sixteenth Day of July, 1996

*Attest:*

*Attesting Officer*

Bruce Lehman

BRUCE LEHMAN

*Commissioner of Patents and Trademarks*